United States Patent [19]

Mochizuki et al.

[11] Patent Number: 4,669,859

[45] Date of Patent: Jun. 2, 1987

[54] DEVELOPING DEVICE

[75] Inventors: Manabu Mochizuki, Yokohama; Itsuo Ikeda, Sagamihara; Tsuneo Kurotori, Tokyo; Satoshi Shinguryo, Kawaguchi; Seiichi Miyakawa, Nagareyama; Yuichi Kobayashi; Mitsuhiro Nonaka, both of Yokohama; Haruhiko Fukuda, Matsudo, all of Japan

[73] Assignee: Ricoh Company, Ltd., Japan

[21] Appl. No.: 477,823

[22] Filed: Mar. 22, 1983

[30] Foreign Application Priority Data

Mar. 23, 1982 [JP] Japan ..... 57-44676
May 10, 1982 [JP] Japan ..... 57-76668
Sep. 16, 1982 [JP] Japan ..... 57-161477

[51] Int. Cl.[4] ..... G03G 15/10

[52] U.S. Cl. ..... 355/10; 118/659; 355/140

[58] Field of Search ..... 355/3 R, 10, 140, 75, 355/300; 118/659, 660

[56] References Cited

U.S. PATENT DOCUMENTS 3,892,481 7/1975 Schaefer et al. ..... 355/10
4,021,111 5/1977 Kuroishi et al. ..... 355/10
4,025,184 5/1977 Mochizuki ..... 355/10
4,087,171 5/1978 Yano ..... 355/14 D
4,141,643 2/1979 Eda et al. ..... 355/10 X
4,168,329 9/1979 Miyakawa et al. ..... 355/10 X
4,213,693 7/1980 Imai et al. ..... 355/10 X
4,247,195 1/1981 Okamoto et al. ..... 355/10 X
4,291,643 9/1981 Kobayashi et al. ..... 355/10 X
4,390,267 6/1983 Minor ..... 355/75 X

FOREIGN PATENT DOCUMENTS 55-133067 10/1980 Japan ..... 355/3 R

*Primary Examiner*—Fred L. Braun
*Attorney, Agent, or Firm*—Guy W. Shoup

[57] ABSTRACT

A developing device for developing an electrostatic latent image formed on an imaging surface includes a developing electrode disposed opposite to the imaging surface and a control circuit for controlling the potential of the developing electrode. In one form, when the control circuit causes the developing electrode to be electrically floating, the upper limit of the voltage excursion is set at different levels as desired. In another form, the control circuit includes a sensor for sensing the potential of the imaging surface thereby allowing to carry out so-called fixed bias or auto-bias developing modes. In a further form, the mode of developing operation is automatically set depending upon the position of a pressure plate which is to be placed on an original for keeping the original in position during copying process.

8 Claims, 21 Drawing Figures

DEVELOPING DEVICE

BACKGROUND OF THE INVENTION

1. Field of the Invention

This invention relates to a developing device for use in electrophotographic machines such as electrophotographic copying machines, electrostatic printing machines, facsimile machines and the like for developing an electrostatic latent image formed on an imaging surface such as a photosensitive member, and, in particular, it relates to a developing device including a developing electrode whose potential is controlled to prevent toner particles from being excessively adhered to the imaging surface.

2. Description of the Prior Art

In wet-type electrophotographic image processing technology, an electrostatic latent image is first formed on an imaging surface and the thus formed latent image is developed by a liquid developer, which is comprised of carrier liquid and toner particles having charges opposite in polarity to the charges forming the latent image and dispersed in the carrier liquid, followed by the step of transferring the thus developed image onto a transfer medium such as paper by means of electrostatic or mechanical pressure means. Such a wet-type developing device usually includes a developing electrode, generally in the form of a curved plate, which is disposed at the bottom of a photosensitive drum with a predetermined gap therebetween. And, a liquid developer is supplied to fill this gap whereby an electrostatic latent image formed on the peripheral surface of the drum is developed. In this case, toner particles charged to a predetermined polarity and dispersed in the carrier liquid are selectively attracted to the imaging or peripheral surface of the drum in accordance with the electric field formed between the developing electrode and that portion of the imaging or peripheral surface of the drum opposite to the developing electrode. When the potential of the developing electrode is set such that it is slightly higher than the potential of the background portion and lower than the potential of the image portion on the imaging surface, it may be so controlled that toner particles adhere only to the image portion and not to the background portion thereby allowing to prevent the occurrence of so-called background contamination.

One prior art approach for controlling the potential of a developing electrode is to apply a fixed bias potential to the developing electrode. Another prior art approach is to provide an electrically floating developing electrode, the potential of which floats as induced by the potential of the developing electrode between predetermined upper and lower limits so as to prevent the deposition of toner particles to the background portion, as disclosed in Japanese Patent Laid-open Publication, No. 51-48341. However, in the former case, problems will be encountered if the potential of the background portion itself increases as in the case where the background portion of an original is colored. The latter case is also not free from disadvantages; for example, if an original image is not a line image and it has a continuously varying gray scale as in the case of a photograph, the potential of the developing electrode will be increased excessively thereby causing excessive deposition of toner particles. This is particularly disadvantageous for modern electrophotographic copying machines designed to supply an increased amount of toner so as to meet the requirements for obtaining high density images and for carrying out the so-called paper-free process, i.e., the process which can be carried out without preference to the kind of paper to be used as a transfer medium.

SUMMARY OF THE INVENTION

Therefore, it is a primary object of the present invention to provide an improved developing device particularly suited for use in developing an electrostatic latent image formed on an imaging surface.

Another object of the present invention is to provide a developing device capable of changing the biasing condition of the developing electrode in accordance with the condition of an electrostatic latent image to be developed.

A further object of the present invention is to provide a developing device capable of maintaining the density of developed images unchanged irrespective of the condition of originals to be reproduced.

A still further object of the present invention is to provide a developing device high in performance and economical in toner consumption.

Other objects, advantages and novel features of the present invention will become apparent from the following detailed description of the invention when considered in conjunction with the accompanying drawings.

DESCRIPTION OF THE PREFERRED EMBODIMENTS

Figure 1:
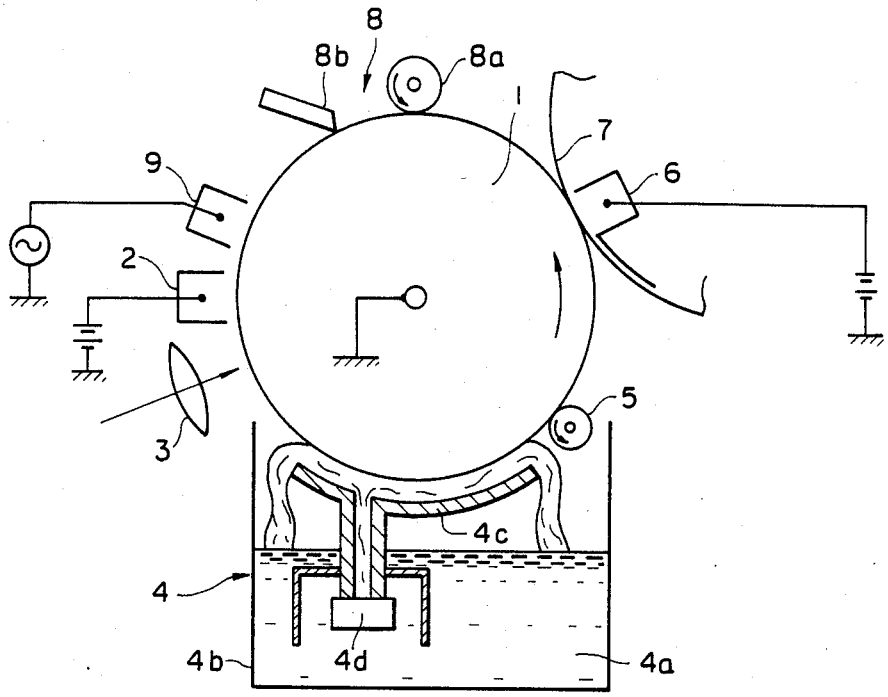
FIG. 1 is a schematic illustration showing one embodiment of the developing device constructed in accordance with the present invention as applied to an electrophotographic copying machine to carry out wet-type development.

Referring now to FIG. 1, there is shown an electrophotographic copying machine to which the present invention is applied. As shown, the copying machine includes a photosensitive drum 1 which is supported to be driven to rotate in a predetermined direction as indicated by the arrow at constant speed and which has a photosensitive member comprised of a photoconductive layer and an electrically conductive backing as formed on the periphery of the drum. In the vicinity of the peripheral surface of the drum 1, there are disposed process devices such as a charging device 2, an image exposing device 3, a developing device 4, a squeeze roller 5, a transferring device 6, a cleaning device 8 and a discharging device 9 arranged in the order mentioned in the rotating direction of the drum 1.

In the illustrated example, the charging device 2 is a positive corona charger for charging the peripheral surface of the drum 1 uniformly to the positive polarity. The developing device 4 includes a container for containing therein a quantity of liquid developer 4*a* and a plate-shaped developing electrode 4*c* which is disposed below and spaced apart from the peripheral surface of the drum 1 over a small distance (typically, a few millimeters or less). The liquid developer 4*a* is supplied to the gap between the developing electrode 4*c* and the drum 1 by means of a pump 4*d* so that the liquid developer 4*a* comes to be brought into contact with the peripheral surface of the drum 1. For example, the liquid developer 4*a* is comprised of carrier liquid and negatively charged toner particles dispersed in the carrier liquid. The squeeze roller 5 removes the excessive amount of the liquid developer from the drum surface to be returned into the container 4*b*. The corona transferring device 6 emits positive corona ions which are deposited onto the back surface of the transfer paper 7, and, thus, the toner image formed on the drum surface is electrostatically attracted to the front surface of the transfer paper 7. The cleaning device 8 in this embodiment includes a cleaning roller 8*a* which is in rolling contact with the drum 1 and a cleaning blade 8*b* which is in scrubbing contact with the drum 1, and it functions to remove the toner particles remaining on the drum surface after transfer. The discharging device 9 is a corona discharging device whose corona wire is connected to an a.c. high voltage source so that it functions to control the surface potential of the drum 1 prior to the next cycle of image forming operation.

In operation, as the drum 1 is driven to rotate at constant speed, the drum surface is uniformly charged by the charger 2 to the positive polarity and the thus uniformly charged surface is exposed to a light image of an original image to be reproduced by the exposure device 3 so that the charge is selectively dissipated thereby forming an electrostatic latent image. This latent image is then developed by the developing device 4 to form a toner image on the drum surface, which is then transferred to the transfer paper 7 by means of the corona transfer device 6. As is well known in the art, the transferred toner image will then be fixed to the transfer paper 7. On the other hand, the toner particles remaining on the drum surface after transfer are removed by the cleaning device 8 and thereafter the drum surface is subjected to a.c. corona ions emitted from the corona discharger 9 thereby making the surface potential of the drum surface uniform at a desired level.

Figure 2:
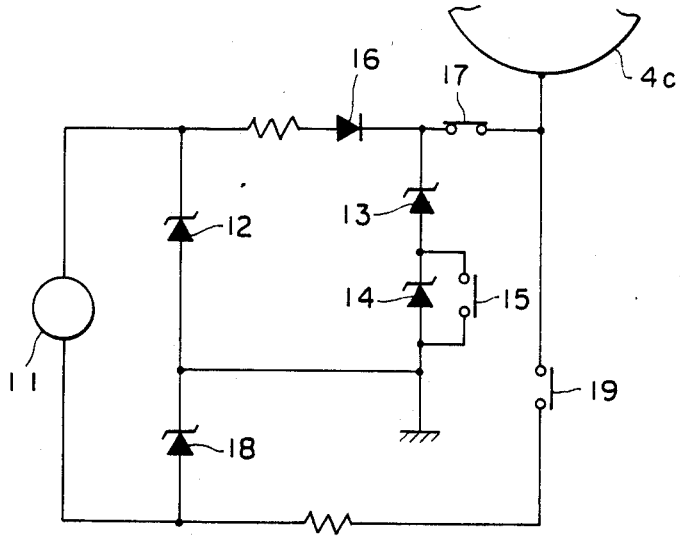
FIGS. 2–4 are circuit diagrams showing a few embodiments of the control circuit for controlling the developing bias potential of the developing electrode constructed in accordance with the present invention.

Now, a description will be made as to the control operation for controlling the bias potential of the developing electrode 4*c* in accordance with the present invention. FIG. 2 shows an embodiment of the control circuit for controlling the bias potential of the developing electrode 4*c* constructed in accordance with the present invention. As shown, a pair of serially connected Zener diodes 13 and 14 are provided as connected between the developing electrode 4*c* and ground through a switch 17. Another switch 15 is provided as connected in parallel with the Zener diode 14. The switch 15 is normally off or open, and upon completion of a series of reproduction process steps after turning the switch 15 on, it is automatically turned off or open. Moreover, another pair of serially connected Zener diodes 12 and 18 are provided as connected across a d.c. voltage source 11. The cathode of the Zener diode 12 is connected to the cathode of the Zener diode 13 through a resistor and diode 16. On the other hand, the junction between the Zener diodes 12 and 18 is connected to ground. Also provided is a switch 19 which is connected between the developing electrode 4*c* and the anode of the Zener diode 18 through a resistor.

Since the serially connected Zener diodes 12 and 18 are connected across the d.c. voltage source, the potential at the cathode of the Zener diode 12 is maintained at a predetermined constant level $V_{B0}$ which is applied to the developing electrode 4*c* through the diode 16 which functions as a rectifying element. The developing electrode 4*c* is electrically floating and there is a small gap in the order of a few millimeters between the developing electrode 4*c* and the opposite portion of the peripheral surface of the drum 1, so that there appears in the developing electrode 4*c* an induced potential, the level of which depends upon the average surface potential of the opposed portion of the drum surface as determined by the area ratio between the background and image portions. Under the condition, in the case where the background portion of an original is colored or the area of an original image such as a photograph is rather large, the average surface potential of the drum surface or photosensitive member increases thereby increasing the induced potential of the developing electrode 4*c*. However, assuming that the switch 17 is on, since the serially connected Zener diodes 13 and 14 are connected between the developing electrode 4*c* and ground the developing electrode 4*c* is maintained at a predetermined potential level. In other words, in the case where the switch 15 is on, the upper limit of the induced potential at the developing electrode 4*c* is set at $V_{B1}$ which is the constant voltage level determined by the Zener diode 13; whereas, in the case where the switch 15 is off, the upper limit is set at $V_{B2}$ which is the constant voltage level determined by the combined thresholds of the Zener diodes 13 and 14 and thus is larger than $V_{B1}$. With the switch 17 off and the switch 19 on, a predetermined negative voltage $V_B$ is applied to the developing electrode 4*c*.

When developing an electrostatic latent image formed on the surface of the drum 1 under the control of the control circuit shown in FIG. 2, in the first place, the switch 17 is turned on and the switch 19 is turned off. In the case of developing an ordinary original which contains a line image, the switch 15 is turned on to set the upper limit of the induced potential at $V_{B1}$. Under the condition, the potential of the developing electrode 4c varies in the range between $V_{B0}$ and $V_{B1}$ in response to the average surface potential of the opposed section of the drum surface, as shown by the one-dotted line in the graph of FIG. 5 whose abscissa is taken for image density (I.D.) and whose ordinate is taken for developing bias potential or the induced potential at the developing electrode 4c. In this case, since the bias potential of the developing electrode 4c is maintained at or above $V_{B0}$, toner particles are prevented from being adhered to the background portion of an image formed on the drum surface and they are only allowed to adhere to the image portion having a higher potential so that background contamination is effectively prevented from occurring.

On the other hand, in the case of an original whose background is colored, the average surface potential on the drum surface increases, which then causes the induced potential of the developing electrode 4c to increase because it is electrically floating. As a result, that portion of the drum surface which corresponds to the colored background portion of the original image is prevented from attracting toner particles thereby allowing to form a transferred image on transfer paper without deposition of toner particles in the background area. Moreover, since the potential of the developing electrode 4c is so controlled not to increase beyond the upper limit $V_{B1}$, even in the case where the color densitv of the background portion of an original image to be reproduced is very high, the potential of the developing electrode 4c is prevented from increasing exceedingly thereby allowing to prevent the resulting developed image, or its image portion, from becoming unacceptably low in image density.

Figure 5:
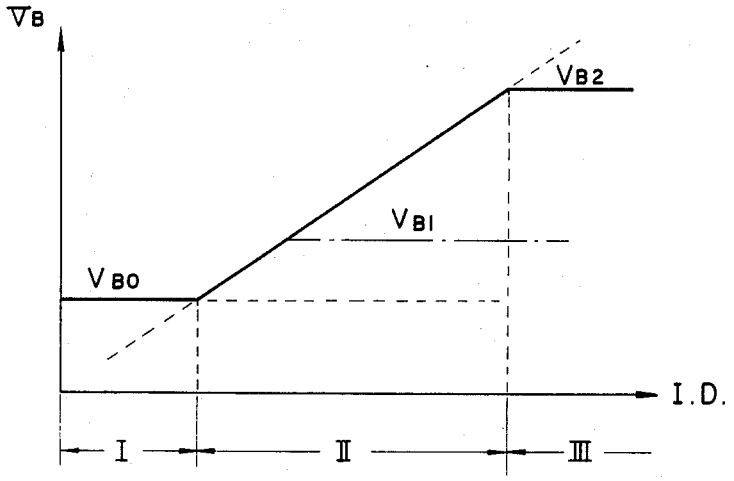
FIGS. 5 and 6 are graphs showing the developing characteristics of the present developing device graphically.

When an original having a continuous tone or gray scale such as a photograph is to be reproduced in accordance with the present invention, the switch 15 is turned off to set the upper excursion limit for the potential of the floating developing electrode 4c at $V_{B2}$, which is higher in potential level than the previously set upper limit $V_{B1}$. When so set, as shown in FIG. 5, the potential of the developing electrode 4c floatingly varies in the range between the lower and upper limits $V_{B0}$ and $V_{B2}$ depending upon the average surface potential of the opposed portion of the drum surface. Accordingly, even in the case where the original to be reproduced is a photograph or the pressure or cover plate must be kept open to carry out the reproduction process since the original to be reproduced is thick such as a book whereby the average surface potential of the drum surface becomes extremely high, in accordance with the present invention, the potential of the developing electrode 4c is also increased to a higher level following the average surface potential of the drum surface so that toner particles are prevented from being deposited onto the drum surface excessivelv. Upon completion of the reproduction process, the switch 15 is automatically turned on.

As apparent from the above description, the lower limit $V_{B0}$ should preferably be set such that it is approximately equal to or slightly higher than the surface potential of the photosensitive member (or drum surface) when it is subjected to blanket exposure, or an original whose surface is all white is exposed. For example, it may be set in the range from 110 to 180 V. Under the condition, the so-called background contamination is prevented from occurring even if an original to be reproduced is almost all white. On the other hand, the first upper limit $V_{B1}$ is preferably set on the basis of the criterion that up to what level of the color density of the background portion of an original should be reproduced as a white background, and it may, for example, be set approximately at 240 V. Furthermore, the second upper limit $V_{B2}$ is preferably set on the basis of such a criterion that for reproducing an original having a continuous tone such as a photograph or having a large black area, the deposition of toner particles is comparable in amount to the case of reproducing ordinary originals and it does not exceed the allowable limit from the viewpoint of toner consumption. For example, if the preferred amount of toner deposition for an original of A4 size is 350 mg, then the second upper limit $V_{B2}$ may be set at 950 V.

Incidentally, if it is desired to remove the toner particles deposited onto the developing electrode 4c, only the drum 1 is driven to rotate over a single turn with the switch 17 maintained off and the switch 19 on by keeping the remaining process devices inoperative. Under the condition, the negative bias potential as determined bv the threshold of the Zener diode 18 is applied to the developing electrode 4c so that the negativelv charged toner particles adhering to the developing electrode 4c are transferred to the peripheral surface of the drum 1 and the thus transferred toner particles are then removed from the drum surface by the cleaning unit 8.

Figure 3:
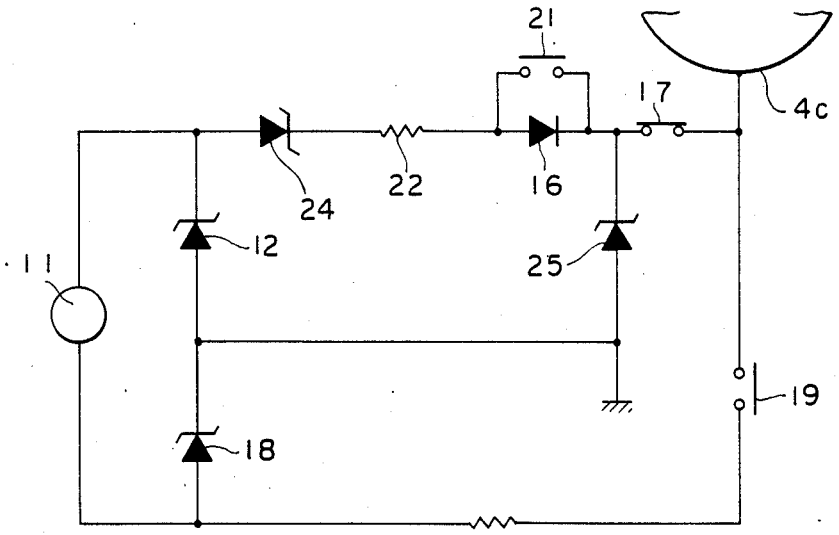

FIG. 3 shows another embodiment of the control circuit for controlling the developing bias potential of the developing electrode 4c constructed in accordance with the present invention. It should be noted that like numerals indicate like elements as practiced throughout the present specification and a description for previously described elements is not repeated unless it appears appropriate. In this embodiment of FIG. 3, provision is made of a Zener diode 25 as connected between the developing electrode 4c through the switch 17 and ground instead of the pair of serially connected Zener diodes 13 and 14 in FIG. 2. Moreover, instead of the switch 15 of FIG. 2, a switch 21 is provided as connected in parallel with the diode 16 as a means for switching the upper potential limit of the developing electrode 4c between $V_{B1}$ and $V_{B2}$. The switch 21 is a normally off, or normally open switch, and it is preferably so structured that it is turned off automatically upon completion of the desired process which is initiated after closure of the switch 21. Also provided are a Zener diode 24 and a resistor 22 which are connected in series between the diode 16 and the Zener diode 12.

Similarly in the embodiment of FIG. 2, the Zener diode 12 regulates the potential to be applied to the developing electrode 4c in cooperation with the d.c. voltage source 11 thereby controlling the lower limit $V_{B0}$ of the potential at the developing electrode 4c. On the other hand, when the switch 21 is closed, the potential of the developing electrode 4c is so controlled not to exceed the first upper limit $V_{B1}$ due to the breakdown voltage of the Zener diode 24. When the switch 21 is off, the potential of the developing electrode 4c is so controlled not to exceed the second upper limit $V_{B2}$ because the Zener diode 25 causes a Zener breakdown if the potential of the developing electrode 4c increases beyond this limit.

In the case when an electrostatic latent image formed from an ordinary original having line images is to be developed, the switches 17 and 21 are turned on with the switch 19 maintained off. Under the condition, the lower and upper limits of the voltage excursion at the developing electrode 4c are set at $V_{B0}$ and $V_{B1}$, respectively, and thus the potential of the developing electrode 4c varies depending upon the average surface potential of the opposed portion of the drum surface in the range between $V_{B0}$ and $V_{B1}$, as shown in FIG. 5. On the other hand, in the case when an original to be processed has a large black area like a photographic picture, the switch 21 is turned off. Under the condition, the potential of the developing electrode 4c is allowed to increase beyond the first upper limit $V_{B1}$; however, it is not allowed to increase beyond the second upper limit $V_{B2}$ which is determined by the Zener breakdown voltage of the Zener diode 25, as also shown in FIG. 5. The switch 21 is automatically turned off upon completion of the desired process such as a reproduction process. As may be understood, similarly with the previous embodiment, this embodiment also allows to carry out development under optimum conditions at all times by a simple switching operation of the switch 21 depending upon the kind or characteristic of an original.

Figure 4:
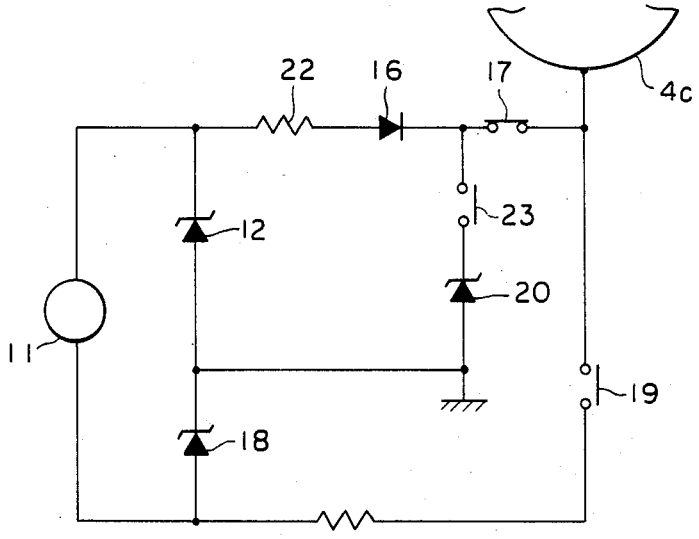
Figure 6:
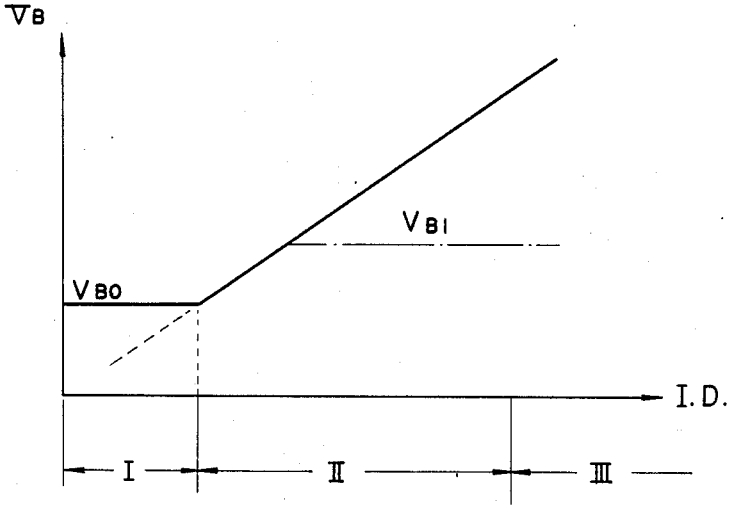

FIG. 4 shows a further embodiment of the control circuit for controlling the potential of the developing electrode 4c embodying the present invention. In this embodiment, instead of the switch 21 in FIG. 3, provision is made of a switch 23 as connected in series with the Zener diode 20. The switch 23 is a normally on, or normally closed switch, and it is automatically turned on upon completion of a desired process initiated after opening of the switch 23. The lower limit $V_{B0}$ of the potential at the developing electrode 4c is set by the Zener diode 12; whereas the upper excursion limit $V_{B1}$ is set by the Zener diode 20 when the switch 23 is on. It is to be noted that in this embodiment the upper limit for the potential of the developing electrode 4c is set only when the switch 23 is on and no upper limit is set when the switch 23 is turned off. The characteristic in operation of this embodiment is graphically shown in FIG. 6. As understood, similarly with the previous embodiments, this embodiment also allows to select an optimum developing condition depending upon the kind of an original to be processed.

Figure 7:
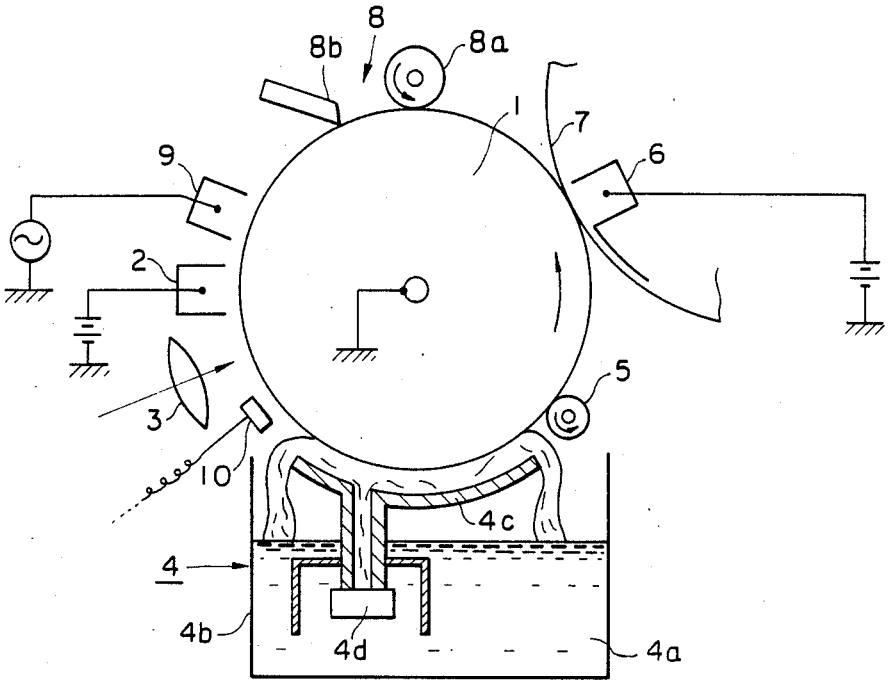
FIG. 7 is a schematic illustration showing another embodiment of the developing device constructed in accordance with the present invention as applied to an electrophotographic copying machine to carry out wet-type development.

It is to be noted that the lower limit $V_{B0}$ is fixed in the above embodiments; however, alternatively, it may be structured into the so-called auto-bias configuration in which the surface potential of the drum is locally detected by a sensor electrode and the lower limit is varyingly set in dependence upon the thus detected potential. Moreover, the above embodiments all relate to wet-type development, but the present invention is equallv applicable to dry-type development FIG. 7 illustrates the overall structure of an electrophotographic copying machine which is obtained by simply adding a sensor 10 for sensing the surface potential of the drum 1 to the structure shown in FIG. 1. The copying machine of FIG. 7 is so structured that the application of an auto-bias system or a float bias system is automatically selected depending upon the surface potential of the imaging surface thereby allowing to obtain developed images of uniform density and to optimize consumption of toner particles irrespective of the condition or kind of an original. In order to attain such an objective, provision is made of the sensor 10 for detecting the level of the surface potential at the imaging surface, or the peripheral surface of the drum 1.

Figure 8:
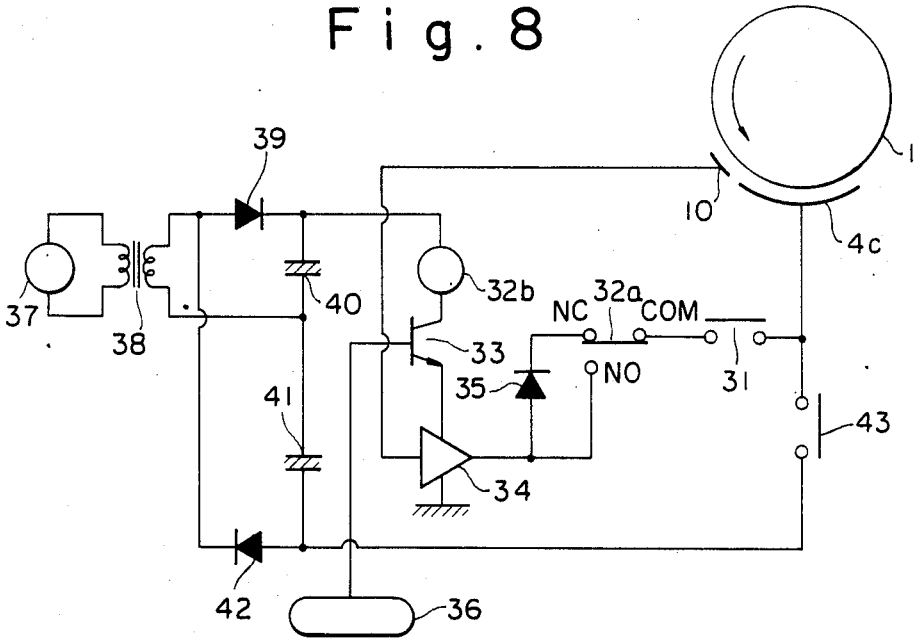
FIG. 8 is a circuit diagram showing another embodiment of the developing bias potential control circuit constructed in accordance with the present invention.

FIG. 8 shows one embodiment of the present invention for controlling the potential of the developing electrode 4c in dependence upon the level of the surface potential of the drum 1 by using the sensor electrode 10. As shown in FIG. 8, the developing electrode 4c is connected to the output of an operational amplifier (hereinafter, also referred to as "op amp") 34 through a switch 31 and a relay switch 32a, which is in operative association with a relay 32b. And, the sensor electrode 10 is connected to an input of the op amp 34, which is also connected to the secondary winding of a transformer 38 through a bipolar transistor 33, relay 32b and diode 39. Thus, when an a.c. voltage is applied to the primary winding of the transformer 38 from an a.c. voltage source 37, the stepped up voltage appearing across the secondary winding is supplied to the op amp 34 as a driving voltage. The op amp 34 amplifies and clamps the surface potential of the imaging surface of the drum 1 as detected by the sensor electrode 10, and then supplies a bias potential as its output to the developing electrode 4c.

The transistor 33 has its emitter connected to the op amp 34 to receive the potential detected by the sensor electrode 10 and its base connected to a voltage supply which supplies a predetermined reference voltage. The collector of the transistor 33 is connected to the relay 32b, and thus, when the transistor 33 is turned on, the relay 32b is energized thereby causing the relay switch 32a to have its contacts COM and NO connected. On the other hand, the relay switch 32a has its other contact NC connected to the output of the op amp 34 via a diode 35. It is to be noted that the switch 31 is operated by a process control unit (not shown) which controls the overall reproduction process of the copying machine such that it is turned on when the image forming area of the peripheral surface of the drum 1 enters the developing section and it is turned off when the image forming area exits the developing section, or the non-image forming area enters the developing section.

Also provided in the circuit of FIG. 8 is a switch 43 which is connected to the secondary winding of the transformer 38 through a diode 42, and the switch 43 is turned on or off by the process control unit in a manner similar to that described with respect to the switch 31. Besides, a pair of serially connected electrolytic capacitors 40 and 41 is connected between the cathode of the diode 39 and the anode of the diode 42 with the junction between the electrolytic capacitors 40 and 41 being connected to one end of the secondary winding of the transformer 38.

Figure 9A:
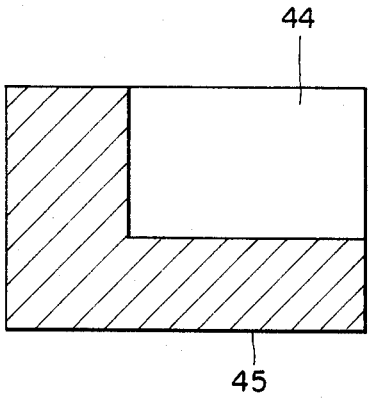
FIGS. 9(A) and 9(B) are schematic illustrations showing different copy sizes and the structure of the shortened developing electrode constructed in accordance with the present invention.
Figure 9B:
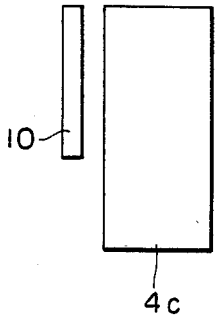

Referring now to FIGS. 9(A) and 9(B), the sensor electrode 10 is so structured to have the length which is equal to or short of the width of the smallest image forming area 44 defined on the peripheral surface of the drum 1. The smallest image forming area 44 usually corresponds to the size of a smallest sheet of transfer paper. On the other hand, the developing electrode 4c is usually so structured to be equal in length or width with the largest image forming area 45 defined on the drum surface. Thus, the sensing electrode 10 is shorter in length than the developing electrode, as best shown in FIG. 9(B).

In operation, when the image forming area defined on the peripheral surface of the drum 1 comes into the developing section, where the developing device 4 is disposed, upon initiation of a reproduction process, the switch 31 is turned on by the process control unit (not shown) and thus the potential of the drum surface in the image forming area (corresponding in length as the size of the smaller image forming area 44) is detected by the sensor electrode 10 whereby the detected potential signal is supplied as an input to the op amp 34. In addition, the detected potential signal is also supplied to the emitter of the transistor 33, and if the detected potential is lower than the reference potential applied to the base of the transistor 33 from the voltage supply 36, the transistor 33 is turned on. If this is the case, a d.c. voltage is supplied to the relay 32*b* due to the combined action between the diode 39 and the electrolytic capacitor 40 so that the relay 32*b* becomes energized and the op amp 34 is activated. Energization of the relay 32*b* establishes an electrical connection between the contacts NO and COM of the relay contact 32*a* so that the output from the op amp 34 is applied to the developing electrode 4*c* via the relay switch 32*a* and the switch 31. In this manner, the auto-bias control is carried out for the developing electrode 4*c* in accordance with the level of an electrostatic latent image to be developed.

When the potential detected by the sensor electrode 10 exceeds the level of the reference potential supplied from the voltage supply 36, the transistor 33 is turned off, which, in turn, causes the relay 32*b* to be deenergized. As a result, the op amp 34 is deactivated thereby having its output grounded; on the other hand, contacts NC and COM of the relay 32*a* are connected. Thus the developing electrode 4*c* is electrically disconnected from its control circuit and set in a floating bias condition.

During a stand-by condition, or a condition in which developing operation is not in progress since the non-image forming area of the drum surface is located in the developing section, the switch 31 is turned off and the switch 43 is turned on. Under the condition, through the combined action between the diode 42 and electrolytic capacitor 41, a d.c. potential opposite in polarity to the developing bias potential (same in polarity as the charges of the toner particles) is applied to the developing electrode 4*c* so that the toner particles deposited onto the developing electrode 4*c* are transferred to the peripheral surface of the drum 1 whereby cleaning of the electrode 4*c* takes place. And the thus transferred toner particles are collected by the cleaning unit 8.

As described above, in the case of an ordinary original having line images, the average surface potential of an electrostatic latent image formed on the drum surface is relatively low, and as long as the potential of the drum surface detected by the sensor electrode 10 is lower in level than the predetermined reference potential from the voltage supply 36, the transistor 33 is rendered conductive and thus a bias potential, which is an output from the op amp 34 and is opposite in polarity to the charge of the toner particles, is applied to the developing electrode 4*c* thereby allowing to prevent the toner particles from being adhered to the background portion of a latent image formed on the drum surface. In this manner, the so-called auto-bias control takes place.

On the other hand, in the case of an original having continuous varying tone or gray scale such as a color or monochromatic picture or print, the average surface potential of an electrostatic latent image formed on the imaging surface of the drum 1 is relatively high, and if the potential detected by the sensor electrode 10 is higher than the predetermined reference potential supplied from the voltage supply 36, the transistor 33 is rendered non-conductive thereby setting the developing electrode 4*c* in an electrically floating condition. Under the condition, there appears in the developing electrode 4*c* a potential which is induced by the surface potential of the imaging surface and thus the potential of the developing electrode 4*c* changes in dependence upon the average surface potential, averaged over the sensing area of the sensor electrode 10 opposed to the imaging surface, of an electrostatic latent image formed on the imaging surface. Accordingly, even in the case when an electrostatic latent image is rather high in potential as in the case of a colored original, since the potential of the developing electrode 4*c* increases correspondingly, toner particles are prevented from being adhered to the imaging surface excessively thereby allowing to avoid the over-consumption of toner particles and to obtain a developed image having a good contrast between the image and background portions.

Since the sensor electrode 10 has a length which is equal to or shorter than the width of the smallest image forming area 44 of the imaging surface, even if an original to be reproduced is small in size, the sensor 10 is prevented from being influenced by the peripheral area, as indicated by hatching in FIG. 9(A). Accordingly, by using the sensor 10, the average surface potential of an electrostatic latent image may be detected at high accuracy.

Figure 10:
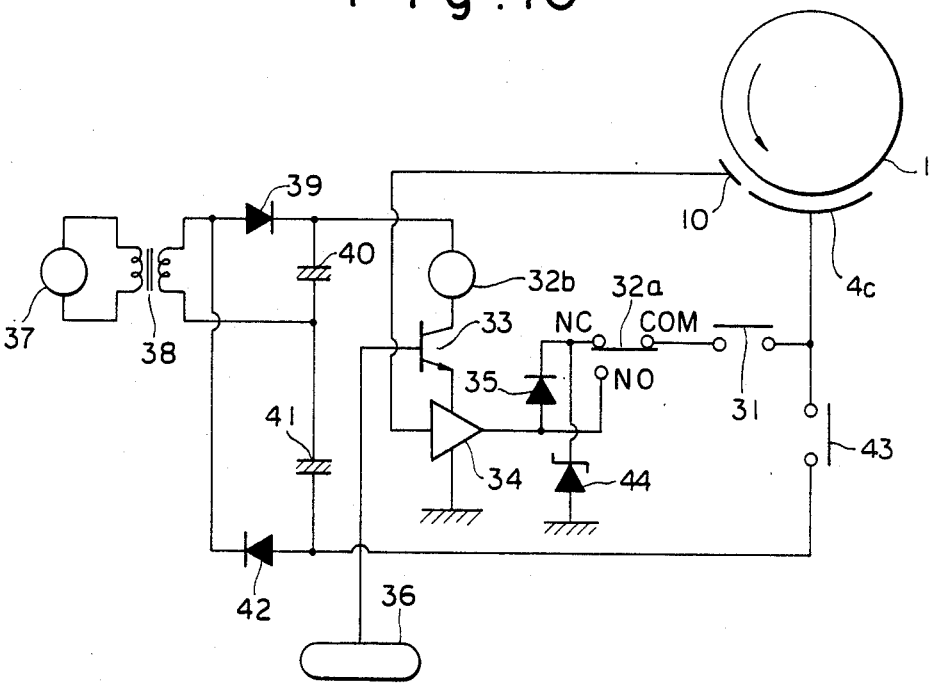
FIG. 10 is a circuit diagram showing a further embodiment of the developing bias potential control circuit constructed in accordance with the present invention.

FIG. 10 shows a still further embodiment of the present control circuit for controlling the potential of the developing electrode 4*c*. The structure shown in FIG. 10 is similar in many respects to that shown in FIG. 8, and the only difference exists in that an upper limit for the potential excursion at the developing electrode 4*c* may be set in the structure of FIG. 10 while it is in the floating bias mode of operation. For this purpose, a Zener diode 44 is added as connected between the contact NC of the relay switch 32*a* and ground.

With such a structure, while the developing electrode 4*c* is electrically floated and the control circuit is in the floating mode, the potential of the developing electrode 4*c* is prevented from increasing indefinitely. That is, in the case of an original having large black areas such as a photographic picture, the potential of an electrostatic latent image increases significantly and thus the potential induced in the developing electrode 4*c* goes up to a higher level. However, since the Zener diode 44 is provided as connected between the developing electrode 4*c* and ground, the Zener diode 44 causes Zener breakdown when the potential of the developing electrode 4*c* reaches a predetermined level so that the potential induced at the developing electrode 4*c* is prevented from increasing indefinitely and thus maintained at a predetermined level thereby preventing the image density from becoming too low even if an electrostatic latent image formed on the imaging surface has an extremely high potential.

Figure 11A:
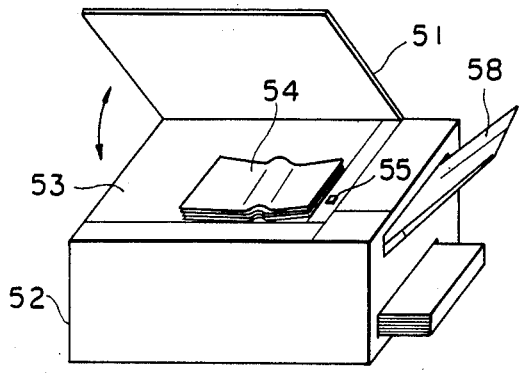
FIGS. 11(A) and 11(B) are schematic illustrations showing the overall structure of an electrophotographic copying machine constructed with the application of one aspect of the present invention.
Figure 11B:
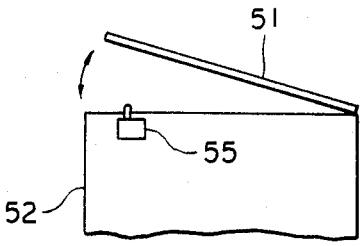

FIGS. 11(A) and 11(B) show a photocopying machine constructed in accordance with one embodiment of the present invention which is capable of switching the modes of operation between the floating bias and auto-bias modes automatically. As shown, the copying machine includes a pressure or cover plate 51 which is pivoted to one end of a housing 52. An original holder 53, which is transparent, is provided at top of the housing 52, and thus an original 54, a book in the illustrated example, may be placed on the original holder 53 with its face having an original image to be reproduced in contact with the original holder 53. Then the pressure plate 51 is placed on the original 54 to keep the original 54 in position during reproduction operation. In accordance with the present invention, there is provided a microswitch 55 at the top surface of the housing 52 as a means for detecting the closing condition or position of the pressure plate 51. That is, when the pressure plate 51 is brought into the closed position, where the pressure plate 51 is substantially in contact with the holder plate 53, the pressure plate 51 engages with the microswitch 55 which is thus turned on thereby detecting the fact that the pressure plate 51 has been brought into the closed position.

As well known in the art, the original 54 placed on the original holder 53 is illuminated by an exposure lamp (not shown) mounted in the housing 52, and the light image formed by the light reflecting from the original 54 is projected onto the imaging surface or the peripheral surface of the photosensitive drum 1 via an optical system (not shown). Thus an electrostatic latent image is formed on the drum surface. Then the potential of the drum surface bearing thereon the thus formed latent image is detected by the sensor 10 disposed upstream of the developing electrode 4c with respect to the rotating direction of the drum 1, and a detection signal from the sensor 10 is supplied as input to a bias potential control circuit 60, which supplies as its output a bias potential, variable or fixed, to the developing electrode 4c in response to the level of the potential detected by the sensor 10.

Figure 12:
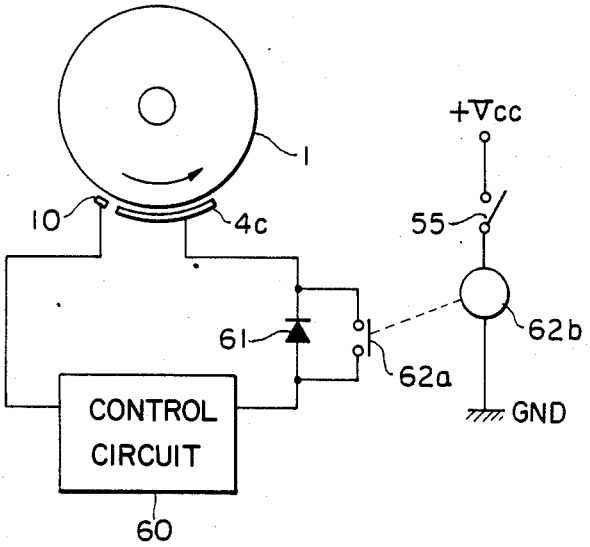
FIG. 12 is a schematic illustration showing the main developing control structure embodied to the copying machine of FIGS. 11(A) and 11(B)

The switch 55 is so structured that it remains off if the pressure plate 51 is not brought into the closed position, for example, due to the fact that the original 54 placed on the original holder 53 is too thick. On the other hand, if the original 54 placed on the original holder 53 is reasonably thin, the microswitch 55 is turned on when the pressure plate 51 is moved onto the original 54. As shown in FIG. 12, when the microswitch 55 is turned on, a relay 62b connected in series with the microswitch 55 between a supply voltage $+V_{CC}$ and ground is energized thereby causing its associated normally open switch 62a to be on. As a result, an output voltage from the control circuit 60 is directly applied to the developing electrode 4c thereby establishing the auto-bias or fixed bias mode depending upon whether the output from the control circuit 60 is variable or fixed. On the other hand, if the switch 55 remains off, the relay 62b is deenergized and thus the normally open switch 62a is off. Therefore, the developing electrode 4c is set in the electrically floating condition through the function of the diode 61. That is, a potential is induced in the developing electrode 4c by the surface potential of an electrostatic latent image formed on the drum surface. Preferably, the diode 61 is formed by a constant voltage type element such as a Zener diode. With this structure, when the induced potential exceeds an upper limit of the auto-bias potential or a fixed bias potential, namely when the induced potential becomes higher than an output potential from the control circuit 60, the diode 61 causes Zener breakdown thereby preventing the developing electrode 4c from increasing in level indefinitely.

It is to be noted that the microswitch 55 may be replaced by other detectors such as photosensors, magnetic reed and piezoelectric switches, etc. for detecting the position of the pressure plate 51.

Figure 13:
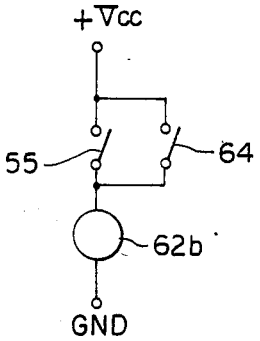
FIG. 13 is a schematic illustration showing a modification of the structure shown in FIG. 12.

FIG. 13 shows a modification of the structure shown in FIG. 12. In this modified structure, an additional switch 64 is provided as connected in parallel with the switch 55. The additional switch 64 is preferably a manually operable switch. In such a structure, even if the switch 55 remains off because the pressure plate 51 cannot be brought into the closed position owing, for example, to the fact that the original 54 is too thick, the switch 64 may be manually turned on to have the relay 62b energized thereby causing the output from the bias circuit to be applied to the developing electrode 4c as a bias potential.

In applying a developing bias potential to the developing electrode of an electrophotographic copying machine using negatively charged toner particles, there is a method called positive bias method, according to which a positive bias potential is applied to the developing electrode, and there is another method called negative bias method, according to which a negative bias potential is applied to the developing electrode. In addition, there is a further method, according to which the bias potential applied to the developing electrode is switched between negative and positive polarities during one cycle of copying operation. In accordance with this further method, during the positive bias period, a part of negatively charged toner particles are attracted to the developing electrode thereby preventing the toner particles from being deposited onto the low potential region, usually a background portion, and, on the other hand, during the negative bias period, the toner particles attracted to the developing electrode are repelled thereby cleaning the developing electrode. The control circuit 60 illustrated in FIG. 12 is a developing bias control circuit constructed according to the positive bias method and thus its output voltage is opposite in polarity to the charges of the toner particles.

Figure 14:
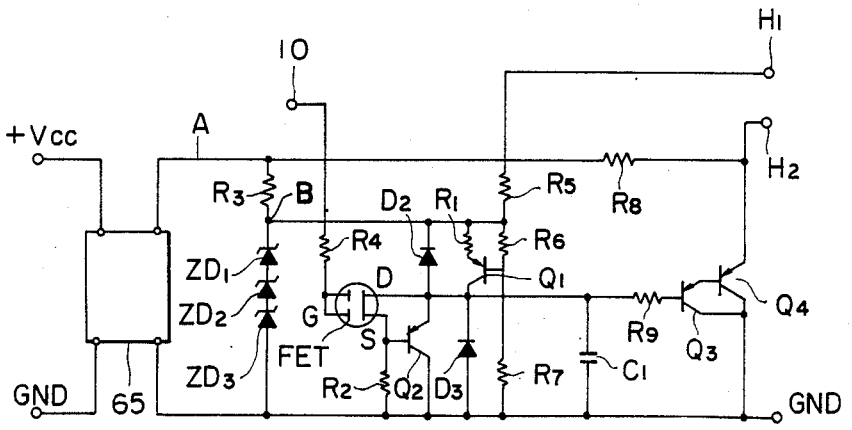
FIG. 14 is a circuit diagram showing the developing bias potential control circuit for controlling the bias potential of the developing electrode constructed in accordance with the present invention.

FIG. 14 shows the detailed structure of one embodiment of the control circuit 60, which is so structured to produce a potential for auto-bias control and another potential for fixed bias control. In FIG. 14, the reference character "65" indicates a D.C.-D.C. converter, "ZD1–ZD3" Zener diodes, "FET" a field effect transistor, "Q1–Q4" transistors, "C1" a capacitor, "D2 and D3" diodes and "R1–R9" resistors. A high potential is produced at node A by means of the D.C.-D.C. converter 65, and a potential at node B, which is determined by a sum of the Zener breakdown voltages of the Zener diodes ZD1–ZD3, is supplied as a fixed bias potential to the developing electrode through a fixed bias terminal $H_1$. There is provided a bipolar transistor $Q_1$ which is always kept on and thus the drain of a field effect transistor FET is approximately equal to potential $V_B$ at node B. A signal from the sensor 10 is applied to the gate of the field effect transistor FET as a gate voltage $V_G$. Under the condition that $V_G$ is smaller than $V_B$ (which is approximately equal to $V_D$), the field effect transistor FET is off. Thus, the transistor $Q_2$ is turned on to lower the potential $V_D$ When the condition is $V_G=V_D$ is reached, the field effect transistor FET is turned on thereby causing the transistor $Q_2$ to be turned off. As a result, this condition of $V_G=V_D$ remains stably and the potential $V_D$ is supplied as an auto-bias output through transistors $Q_3$ and $Q_4$ at an auto-bias terminal $H_2$. It is so structured that a resistor $R_1$ is much smaller in resistance value than a resistor $R_2$. On the other hand, in the case where $V_G$ is equal to or larger than $V_B$, the field effect transistor FET is turned on and the potential $V_B$ is supplied as an auto-bias output to the terminal through transistors $Q_3$ and $Q_4$.

Figures 15A, 15B, 15C:
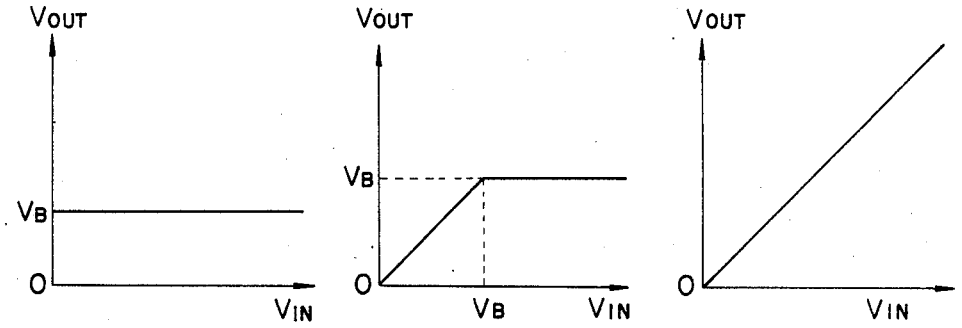
FIGS. 15(A)–15(B) are graphs useful for explaining the operating characteristics of the control circuit of FIG. 14.

FIGS. 15(A)-15(C) are graphs showing the characteristics between an input signal $V_{IN}$ supplied from the sensor 10 and a bias output $V_{OUT}$ in different biasing conditions as described above. FIG. 15(A) is the case for fixed bias mode and the bias potential applied to the developing electrode 4*c* remains constant independently of the level of the surface potential of the drum 1. Thus, for those originals having smaller image portions, since the surface potential of the drum 1 becomes lower than the fixed bias potential $V_B$, the resulting developed images are relatively low in density; whereas, for those originals having larger image portions, the surface potential of the drum 2 becomes higher than $V_B$ so that developed images are relatively higher in density. FIG. 15(B) shows the characteristics of auto-bias mode, in which case, while the potential $V_{IN}$ detected by the sensor 10 is lower than $V_B$, the auto-bias output potential $V_{OUT}$ varies in proportion to the input $V_{IN}$ thereby keeping the resulting density constant. However, even if the detected potential $V_{IN}$ exceeds $V_B$, the auto-bias output remains constant at VB so that the higher the surface potential of the drum 1, the higher the density of the developed image. Finally, FIG. 15(C) shows the characteristics of floating bias mode, and in this case, the bias potential $V_{OUT}$ to be applied to the developing electrode 4*c* varies in proportion to the potential detected by the sensor 10 so that the resulting developed images will be all uniform in density.

Figure 16:
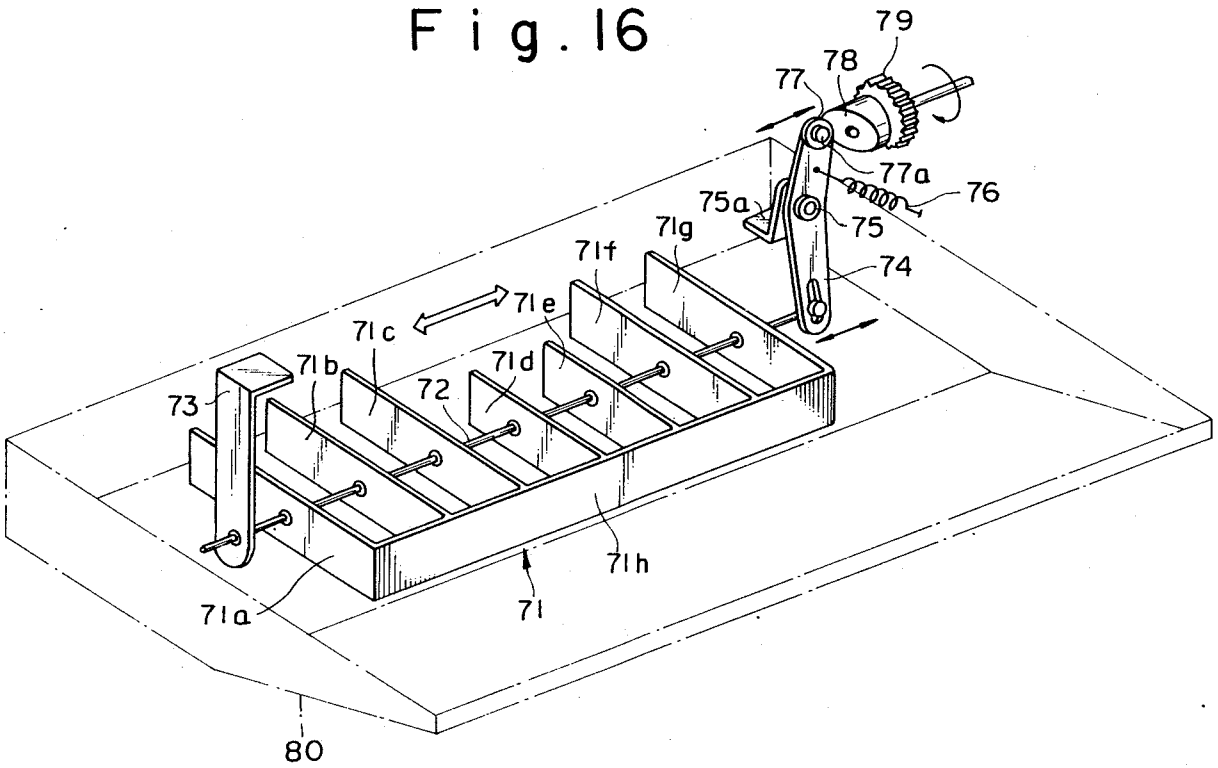
FIGS. 16 and 17 are perspective views each showing the liquid developer stirring structure which may be applied to the present invention.

FIG. 16 shows the structure for maintaining the concentration of liquid developer constant which may be advantageously applied to the present developing device. As shown, a container for containing a quantity of liquid developer is indicated by the one-dotted line 80, and it is generally comprised of two sections: a first section having a flat bottom and a second section having an inclined bottom. The container 80 is covered by a lid at least partly, though such a lid is not specifically shown in FIG. 16. A pair of support arms 73 and 75*a* is provided as fixedly mounted on a housing (not shown), and one end of a rod 72 movably extends through a hole provided at the bottom end of the arm 73. A lever 74 is pivotally mounted on the support arm 75*a* at 75 and the bottom end of the lever 74 is operatively connected to the other end of the rod 72. As a result, the rod 72 may move reciprocatingly in parallel with the bottom surface of the container 80. A plurality of vanes 71*a* through 71*g* are fixedly mounted on the rod 72 spaced apart from one another with a predetermined pitch with their planes generally vertical to the bottom surface of the container thereby forming a stirring member 71. One end of each of the vanes 71*a* through 71*g* extends up to the position close to the boundary between the first and second sections of the container 80 and these ends of the vanes closer to the boundary are connected to a common vane 71*h*. The other ends of the vanes 71*a* through 71*g* extend closer to the wall of the container 80 except those where a pump (not shown) is to be disposed. It is to be noted that the bottom edges of the vanes are in contact with the bottom surface of the container 80 and thus they scrub the bottom surface of the container 80 when driven to move as will be described later.

The top end of the lever 74 is provided with a pin 77*a* which rotatably supports a roller 77. An end face cam 78 having a slanted end face which is in engagement with the roller 77 is provided coaxially and integrally with a gear 79. Thus, the gear 79 is externally driven to rotate and the rotation of the cam 78 causes to pivot the lever 74 back and forth around the pivot 75. It is to be noted that a spring 76 is provided to keep the roller 77 biased against the inclined end surface of the cam 78. Preferably, the stroke of movement of the stirring member 71 is so set to be larger than the pitch of the vanes 71*a*-71*g*. With such a structure, when the gear 79 is driven to rotate, the lever 74 executes a pivotal motion through engagement with the cam 78 so that the stirring member 71 moves in a reciprocating manner along the lengthwise direction of the rod 72. Accordingly, the toner particles dispersed in the carrier liquid are always insured to be uniformly distributed in the carrier liquid and they are prevented from being deposited on the bottom surface of the container 80. It is to be noted that the support arms 73 and 75*a* may be fixedly mounted on a lid (not shown) to cover the container 80 as a unit. When so structured, the stirring unit of FIG. 16 may be easily detached from or mounted into an associated developing device.

Figure 17:
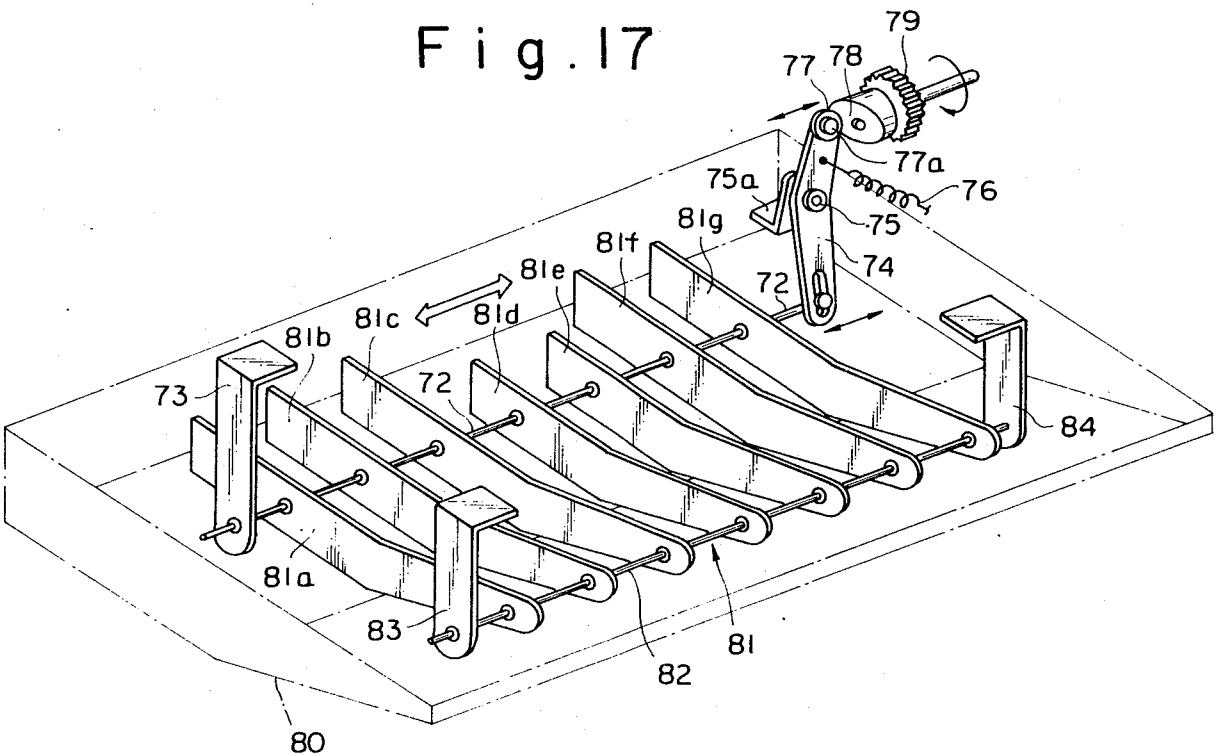

FIG. 17 shows a modification of the stirring unit, and in this modified structure, instead of the shorter-sized vanes 71*a*-71*g*, longer-sized vanes 81*a*-81*g* are provided. These longer-sized vanes 81*a*-81*g* extend beyond the boundary between the first and second sections of the container 80 and thus the extended portions of the vanes 81*a*-81*g* are inclined in compliance in shape with the inclined bottom surface of the second section of the container 80. These vanes 81*a*-81*g* are fixedly but loosely mounted on the rod 72 spaced apart from each other at a predetermined pitch. Another pair of support arms 83 and 84, preferably fixedly mounted on the lid (not shown) of the container 80, is provided, between which is fixedly supported a stationary rod 80 to which one end of each of the vanes 81*a*-81*g* is fixedly but loosely connected. Accordingly, that end of each of the vanes 81*a*-81*g* which is fixedly but loosely connected to the stationary rod 82 does not move substantially even if the movable rod 72 is driven to move in a reciprocating manner as described with reference to the previous structure shown in FIG. 16. This modified structure is advantageous because when the rod 72 is driven to move back and forth, since the stationary rod holds the connecting ends of the vanes 81*a*-81*g* fixed in position, the vanes 81*a*-81*g* execute the motion akin to wipers of the automobiles. Thus the vanes 81*a*-81*g* move back and forth with their ends connected to the stationary rod 82 as their fulcrums. As a result, the liquid developer is forced to move toward the inclined section of the container 80 thereby causing the toner particles dispersed in the carrier liquid to drift toward the top surface of the carrier liquid, which indicates a vigorous agitation or stirring effect.

It is to be noted that vanes may be formed by any desired material such as metal, plastics, resins or a combination of these. If the vanes are sufficiently flexible, they may be fixedly mounted on the rod or rods without looseness therebetween.

While the above provides a full and complete disclosure of the preferred embodiments of the present invention, various modifications, alternate constructions and equivalents may be employed without departing from the true spirit and scope of the invention. Therefore, the above description and illustration should not be construed as limiting the scope of the invention, which is defined by the appended claims.

What is claimed is:

1. A developing device for developing an electrostatic latent image formed on an imaging surface, comprising:

a developing electrode disposed opposite to said imaging surface with a predetermind gap therebetween;

means for supplying a developer to said gap thereby bringing said developer in contact with said imaging surface;

sensor means for sensing the potential of said imaging surface prior to development; and control means, responsive to a detection signal from said sensor means, for controlling the potential of said developing electrode, said control means applying a potential determined in accordance with the level of the potential of said imaging surface detected by said sensor means as long as said detected potential is below a predetermined level and said control means causing said developing electrode to be electrically floating when said detected potential exceeds said predetermined level.

2. A device of claim 1 wherein said sensor means includes a sensor electrode disposed opposite to said imaging surface, said sensor electrode having a length not to exceed the width of a smallest image forming area determined in said imaging surface.

3. A device of claim 1 wherein said control means includes a constant voltage element which is connected between said developing electrode and a reference potential when said control means causes said developing electrode to be electrically floating.

4. A device of claim 3 wherein said constant voltage element is a Zener diode and said reference potential is ground.

5. A developing device for use in an electrophotographic copying machine including a housing, an original holder for holding thereon an original to be reproduced, a pressure plate to be placed on said original to keep said original in position, a photosensitive member, and means for forming an electrostatic latent image of said original on said photosensitive member, said developer device comprising:

a developing electrode disposed opposite to said photosensitive member with a predetermined gap therebetween;

means for supplying a developer to said gap;

means for applying a bias potential to said developing electrode;

means for causing said developing electrode to be electrically floating; and switch means for switching said means for applying to an operative state and said means for causing to an inoperative state when said pressure plate is at a closed position and switching said means for applying to an inoperative state and said means for causing to an operative state when said pressure plate is not at said closed position.

6. A device of claim 5 wherein said switch means includes a first switch mounted on top of said housing for detecting that said pressure plate is in said closed position and said means for applying is set to the operative state when said first switch has detected said pressure plate to be in said closed position.

7. A device of claim 6 further comprising sensor means for sensing the potential of said photosensitive member prior to development wherein the bias potential applied to said developing electrode by said means for applying varies in accordance with the level of the potential of said photosensitive member sensed by said sensing means.

8. A device of claim 6 wherein said switch means further includes a second switch which may be operated to set said means for applying operative irrespective of the position of said pressure plate.

* * * * *